US005292206A

United States Patent [19]

Sonck et al.

[11] Patent Number: 5,292,206

[45] Date of Patent: Mar. 8, 1994

[54] DEVICE FOR SEALING A CAISSON IN A WATERTIGHT WAY

[75] Inventors: Willy Sonck, Denderleeuw; Eric Van Draege, Lokeren, both of Belgium

[73] Assignee: General Coatings, Erembodegem, Belgium

[21] Appl. No.: 946,272

[22] Filed: Sep. 16, 1992

[30] Foreign Application Priority Data

Sep. 18, 1991 [BE] Belgium ..... 09100864

[51] Int. Cl.[5] ..... B63C 11/00; B63C 11/40

[52] U.S. Cl. ..... 405/12; 405/13

[58] Field of Search ..... 405/12, 8–11, 405/13, 14, 1; 114/227, 259

[56] References Cited

U.S. PATENT DOCUMENTS 2,166,865 7/1939 Gerdes ..... 405/12
3,768,265 10/1973 Brouillette ..... 405/12
4,696,597 9/1987 Sonck ..... 405/12

FOREIGN PATENT DOCUMENTS

3914228A1 10/1981 Fed. Rep. of Germany .
WO88/02718 4/1988 PCT Int'l Appl. .

*Primary Examiner*—Dennis L. Taylor
*Attorney, Agent, or Firm*—Fitch, Even, Tabin & Flannery

[57] ABSTRACT

The invention relates to a device for sealing a caisson comprising a bottom, two upright side walls and a back wall, and intended for carrying out works to a sheet pile wall below the water line, characterized in that it comprises the combination of an inflatable continuous air chamber (8); a series of deformable sealing elements (9); a core (10) which can be displaced between each of said sealing elements (9) and the air chamber (8) and guiding plates (11) and means for allowing the lateral displacement of said sealing elements with respect to the caisson.

9 Claims, 8 Drawing Sheets

DEVICE FOR SEALING A CAISSON IN A WATERTIGHT WAY

The present invention relates to a device for sealing a caisson in a watertight way, which caisson comprises a bottom, two upright side walls and a back wall, and is intended for carrying out works below the water line to a sheet pile wall having a longitudinal profile composed of a succession of grooves and ridges, the bottom of the caisson being sealed by using slidable sealing elements having a profile which is roughly adapted to the profile of the grooves in the sheet pile wall.

Devices of the above mentioned type have already been developed previously by the applicant and are described in its Belgian patents n° 902.531 of May 29, 1985 and n° 903.213 of Sep. 11, 1985.

Although the devices according to these patents are satisfying, a device has now ben developed which is characterized with respect to the first devices by a strongly improved adaptability to sheet pile walls having locally an irregular profile. An object of the present invention is therefore to provide a device which ensures an almost automatic adaptation of the components to a sheet pile wall and which guarantees therefore an improved sealing.

In order to realize this according to the invention, the device according to the invention comprises the combination of:

a) an inflatable continuous air chamber extending over the total width of the caisson and along the upright side walls thereof;

b) a series of deformable sealing elements having a profile approaching the profile of a groove, which elements are mounted between two horizontal guiding plates disposed one above the other in a manner such as to allow a displacement of the elements in the direction of the sheet pile wall in front of the grooves therein while said inflatable air chamber is provided for pressing these elements against the wall;

c) a core provided between each of said sealing elements and the air chamber, which core is adapted to be displaced between said guiding plates and is fixed to the adjoining sealing element; and d) means for allowing a lateral displacement of said sealing elements together with the guiding plates above and underneath these sealing elements with respect to the caisson.

Still according to the invention, said deformable sealing element is made of foam rubber or a technically equivalent material comprising an outer layer of vulcanized rubber.

In a preferably applied embodiment of the invention, said rigid core is provided with at least a pair, but preferably two pairs of shafts projecting through slots in said horizontal guiding plates between which said air chamber and said core are also mounted.

Other details and advantages of the present invention will become apparent from the following description of a device for sealing a caisson in a watertight way according to the invention. This description is only given by way of example and does not limit the scope of the invention. The reference numerals relate to the annexed figures.

Figure 1:
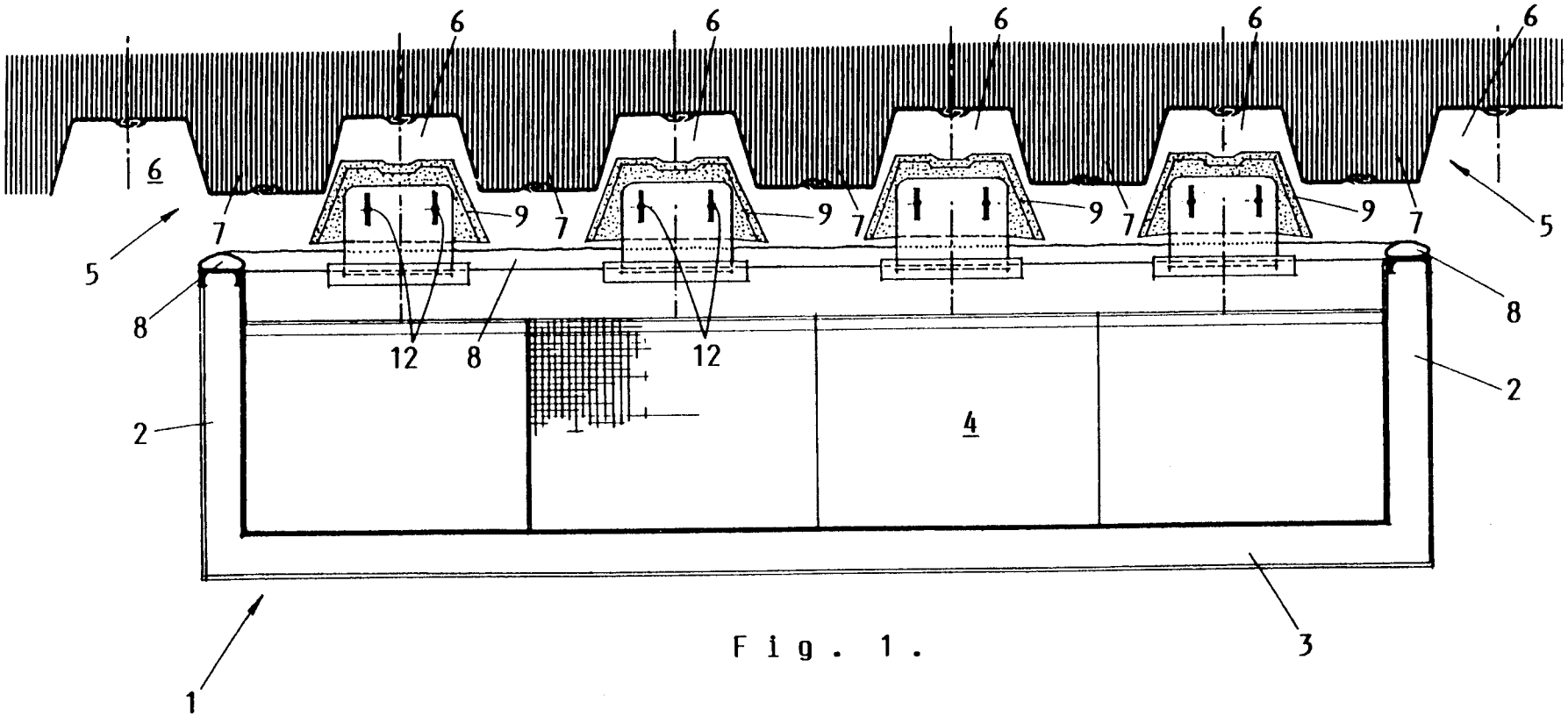
FIG. 1 shows a top plan view of the device according to the invention in the case of an ideal sheet pile wall.
Figure 8:
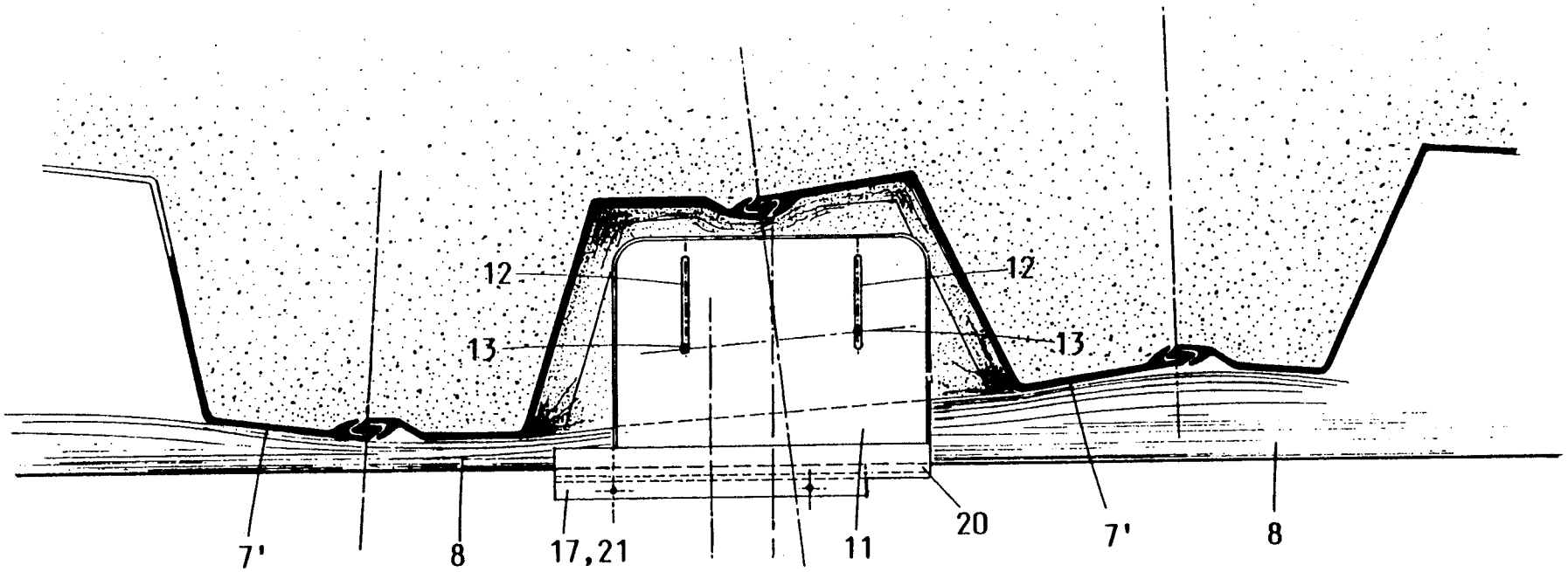
FIG. 8 illustrates, according to a top plan view, the way wherein a sealing element is adaptable to a deformed sheet pile profile.

The device shown in these different figures consists of a caisson 1 comprising in a usual way two upright side walls 2 and an upright back wall 3. A floor 4 fits at the bottom to these three walls. Reference 5 indicates in the figures the sheet pile wall. The sheet pile walls for which the device is designed, are made by connecting sheet piles of such a transverse profile that, after having connected the sheet piles one to another, there is formed a wall with a succession of grooves 6 and ridges 7 directed towards the caisson 1. A sheet pile wall can therefore present a regular longitudinal profile (FIG. 1) or deformations such as shown in FIG. 8.

The deformation of one or two adjoining sheet piles results in the latter case in such a deformation that sealing the floor of the hitherto known caissons in a watertight way becomes totally impossible.

The concept of the device according to the invention does not only solve this problem integrally but the desired watertightness can be obtained almost automatically, which means that the components of the device does not have to be adjusted manually with respect to the deformed sheet pile wall.

Figure 3:
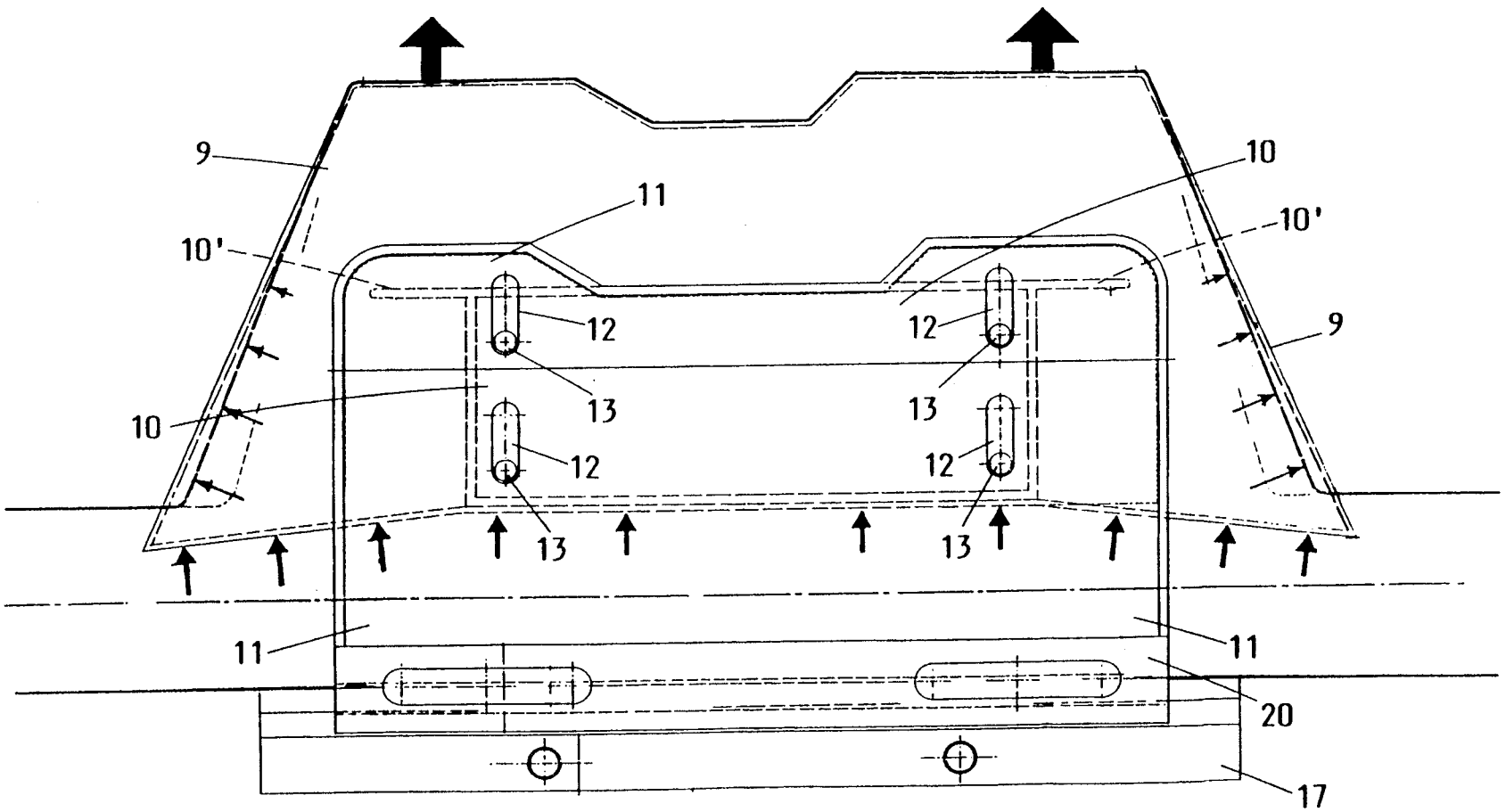
FIG. 3 shows a top plan view of a sealing element with the components going therewith.
Figure 4:
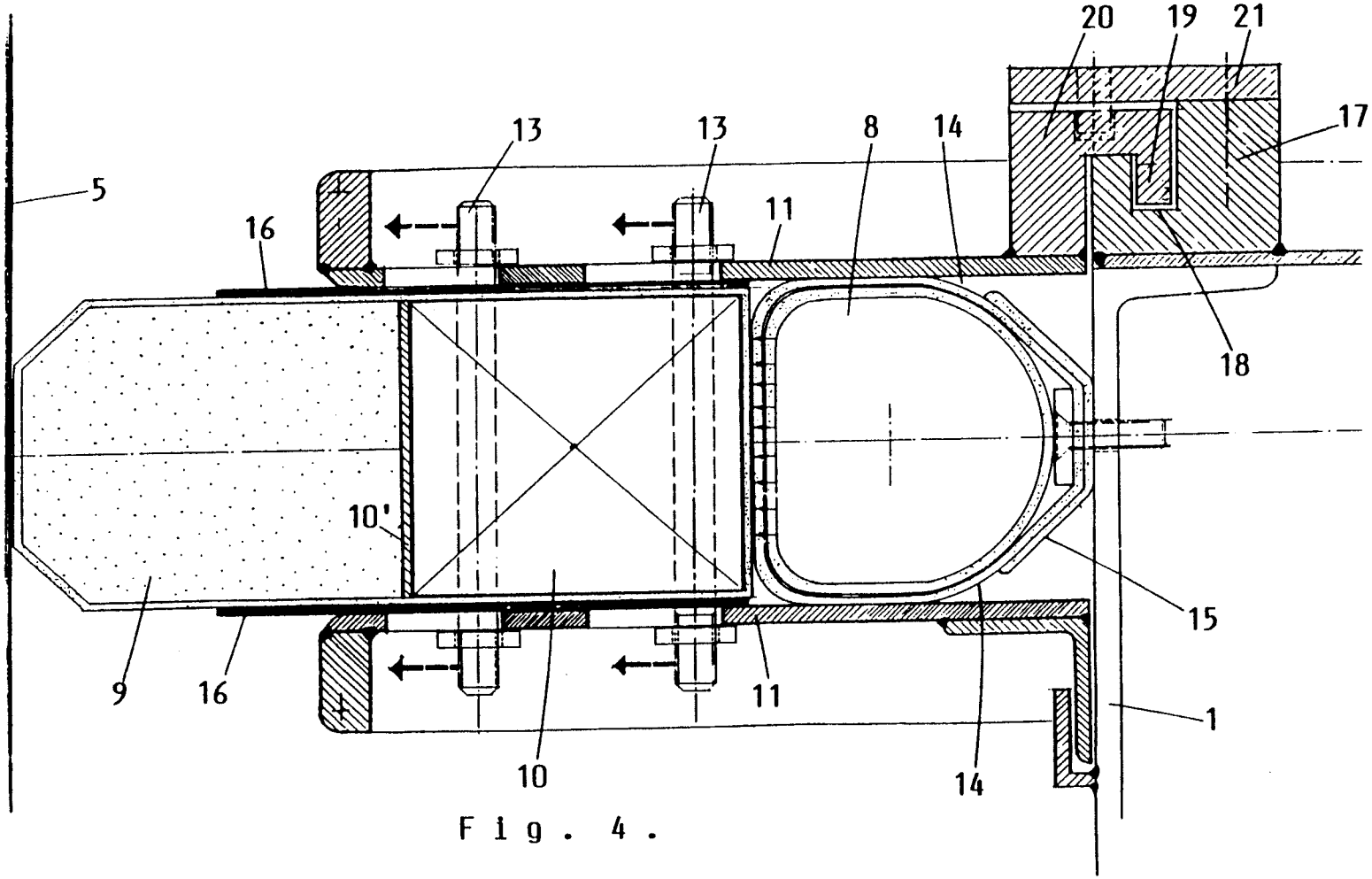
FIG. 4 shows, on another scale, a cross section according to the Y-axis of FIG. 3.
Figure 5:
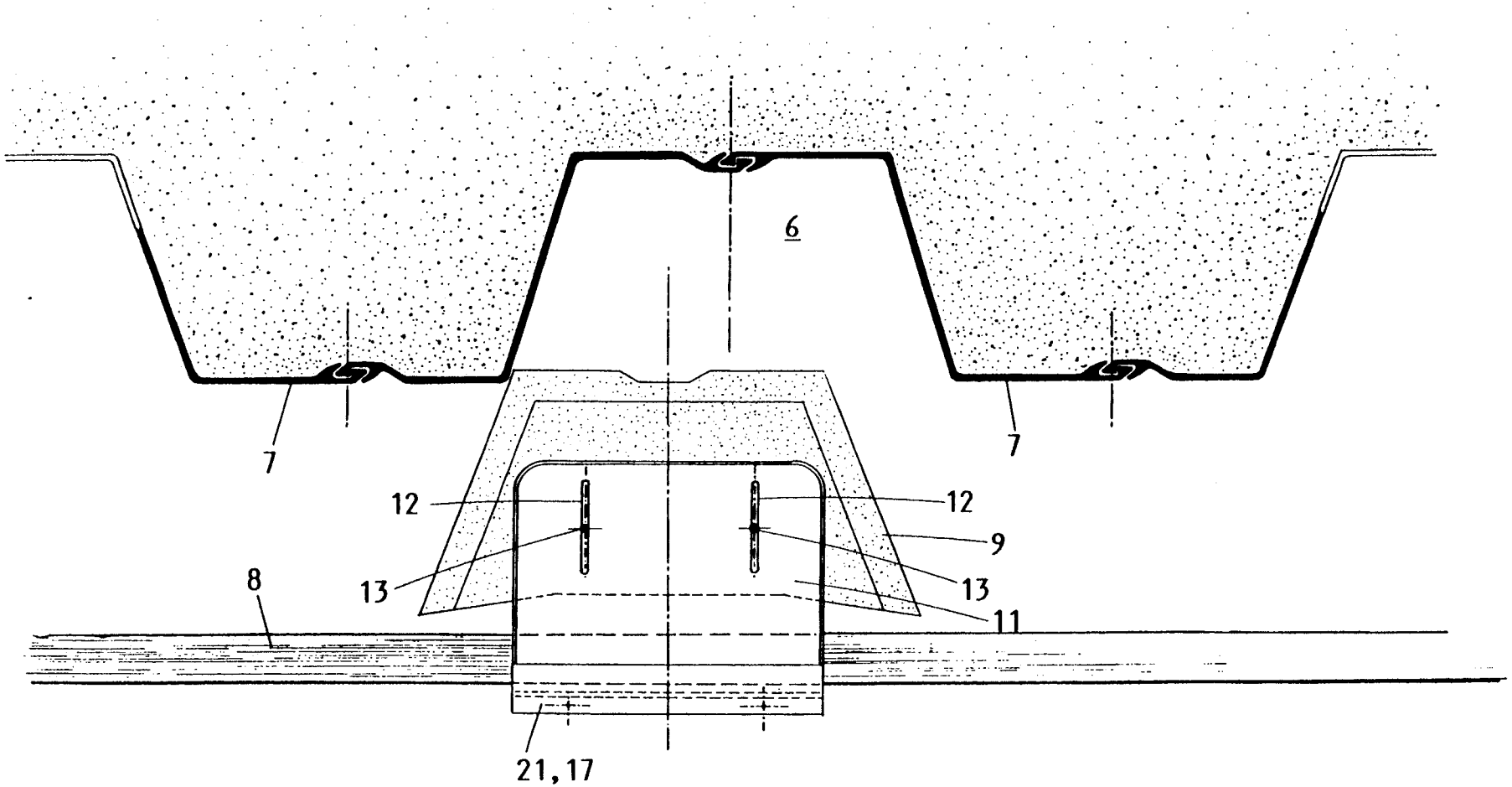
FIG. 5 shows, according to a top plan view, a possible position of a sealing element in front of a groove in a sheet pile wall.
Figure 6:
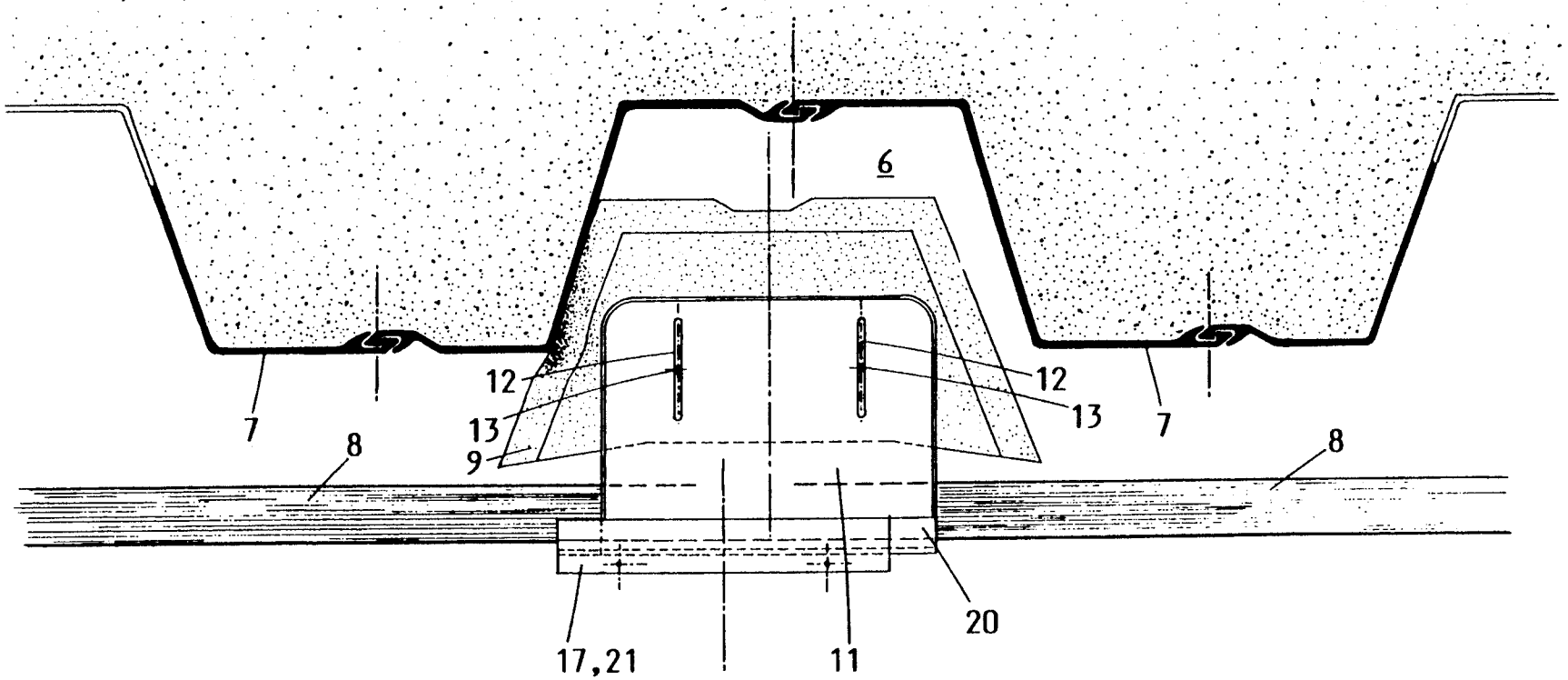
FIG. 6 shows, according to a top plan view, the position of the same sealing element which approaches it final position.
Figure 7:
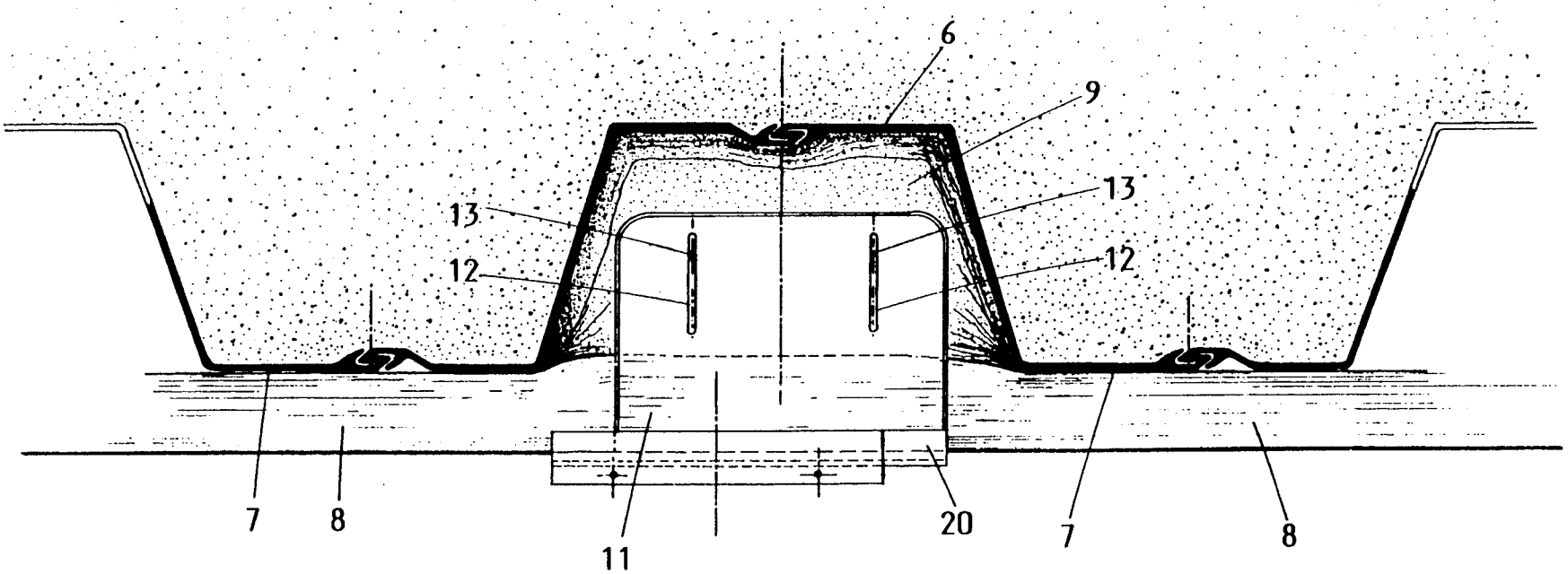
FIG. 7 shows, according to a top plan view, a sealing element in its final position.

In accordance with the invention, an inflatable continuous air chamber 8 is fixed over the entire length of the caisson 4 and over the height of the side walls 2, while in front of, or substantially in front of each groove 6, there are provided deformable sealing elements 9, the profile of which corresponds substantially to the profile of the grooves 6 in the sheet pile wall 5. Each sealing element 9 is connected to a core 10. In the embodiment shown in the figures, the core 10 is a rigid core and consists for example of wood. However, it is also possible to use an inflatable core which allows to push the sealing elements better in the grooves of the sheet pile wall and in particular laterally against the oblique side walls of these grooves. In the event of a rigid core 10, a steel plate 10' (FIGS. 3 and 4) is advantageously fixed on the front side onto this rigid core in order to increase the pressure surface of this core on the deformable sealing elements. The deformable sealing elements 9 as well as the rigid core 10 are mounted between guiding plates 11. These guiding plates include slots 12. Shafts 13 which are fixed into the rigid core 10 project at the top and at the bottom through the respective slots 12 in order to guide the unit composed of the sealing elements 9 and the rigid core 10 connected thereto. Between the same guiding plates 11 there is guided each time also the inflatable air chamber 8.

The inflatable air chamber 8 is enclosed over the entire length of the caisson and also along the upright side walls in a continuous elastic thimble 14 which is received, in a advantageous embodiment, in a gutter 15 having widely spread arms and which is connected locally with usual means, for example by means of screws, to the walls of the caisson.

In order to obtain a good guiding of the deformable sealing elements 9 and their core 10, they are connected a the top and at the bottom to sliding characteristics of the sealing elements 9 and the rigid core 10 to and fro between the guiding plates. For such a material, use can be made for example of the product which is put on the market under the trade mark "teflon".

Before describing the functioning of the device in detail and before underlining the advantages of the new structures, attention can further be drawn to means which enable the longitudinal displacement of the sealing elements together with the guiding plates with respect to the caisson or more particularly with respect to the grooves of the sheet pile wall.

In order to ensure a smooth and practically automatic longitudinal adjustment, use is made of a metal fence 17 comprising a longitudinal groove 18 adapted to the L-shaped portion 19 of the angle bar 20. The angle bar 20 which is fixed to the uppermost guiding plate 11 is covered by the slat 21 fixed t fence 17. These different components are shown very clearly in FIG. 4.

Now that the structures of the caisson together with the different sealing elements have been described, the working of the different components can be clarified with reference to the different figures.

The caisson is pushed by conventional means against the sheet pile wall depending on local circumstances until the inflatable air chamber 8 contacts the ridges 7 of the sheet piles while the deformable sealing elements 9 of foam rubber or a technically equivalent material penetrate into the different grooves 6 of the sheet pile wall. Due to the fact that the guiding plates 11 can be displaced in the longitudinal direction of the caisson, the sealing elements 9 adapt themselves perfectly to the shape of the grooves 6 in the sheet pile wall. By pressurizing the inflatable air chamber 8, there is obtained, on the one hand, a good sealing between the caisson and the ridges 7, as well in the horizontal as in the vertical direction, in the latter case along the side walls 2, and, on the other hand, between the deformable sealing elements 9 and the sheet pile wall in front of the different grooves 6.

Indeed, the inflatable air chamber 8 will push against the rigid core 10 in such a manner that the sealing elements 9 of foam rubber or of a technically equivalent material will anchor themselves under pressure exactly into the grooves. The sealing is realized therefore as well in the longitudinal direction as in the transverse direction of the caisson and involves therefore not the slightest difficulty when the sheet pile wall presents no defects as shown amongst others in FIGS. 1, 3, 5, 6 and 7. Also when the sheet pile wall is deformed considerably, as represented by way of example in FIG. 8, the deformable sealing elements 9 will adapt themselves excellently, in front of grooves which are deformed, to the shape of these irregular grooves. This is caused, on the one hand, by the presence of the inflatable continuous air chamber 8 which adapts itself well to the abnormalities in the ridges 7' (FIG. 8) and, on the other hand, exerts a uniform pressure onto the deformable sealing elements 9.

The same FIG. 8 shows moreover the lateral displacement of two guiding plates 11 together with a sealing element 9 mounted therebetween with respect to a fence 17. This displacement is realized automatically without the intervention of an operator of the device.

In order to obtain a good sealing under all possible circumstances between the deformable sealing elements 9 and the grooves 6, the surface of the trapezial sealing elements is always somewhat larger than the surface of the groove wherein they have to fit. This is also shown particularly well in FIG. 3.

After this description of the elements which characterize the structure of the device according to the invention, the advantages of the device according to the invention are particularly conspicuous.

Due to the fact that the sealing elements 9 can move freely in the lateral direction, they take in their correct place automatically when the caisson is pushed against the sheet pile wall.

Figure 2:
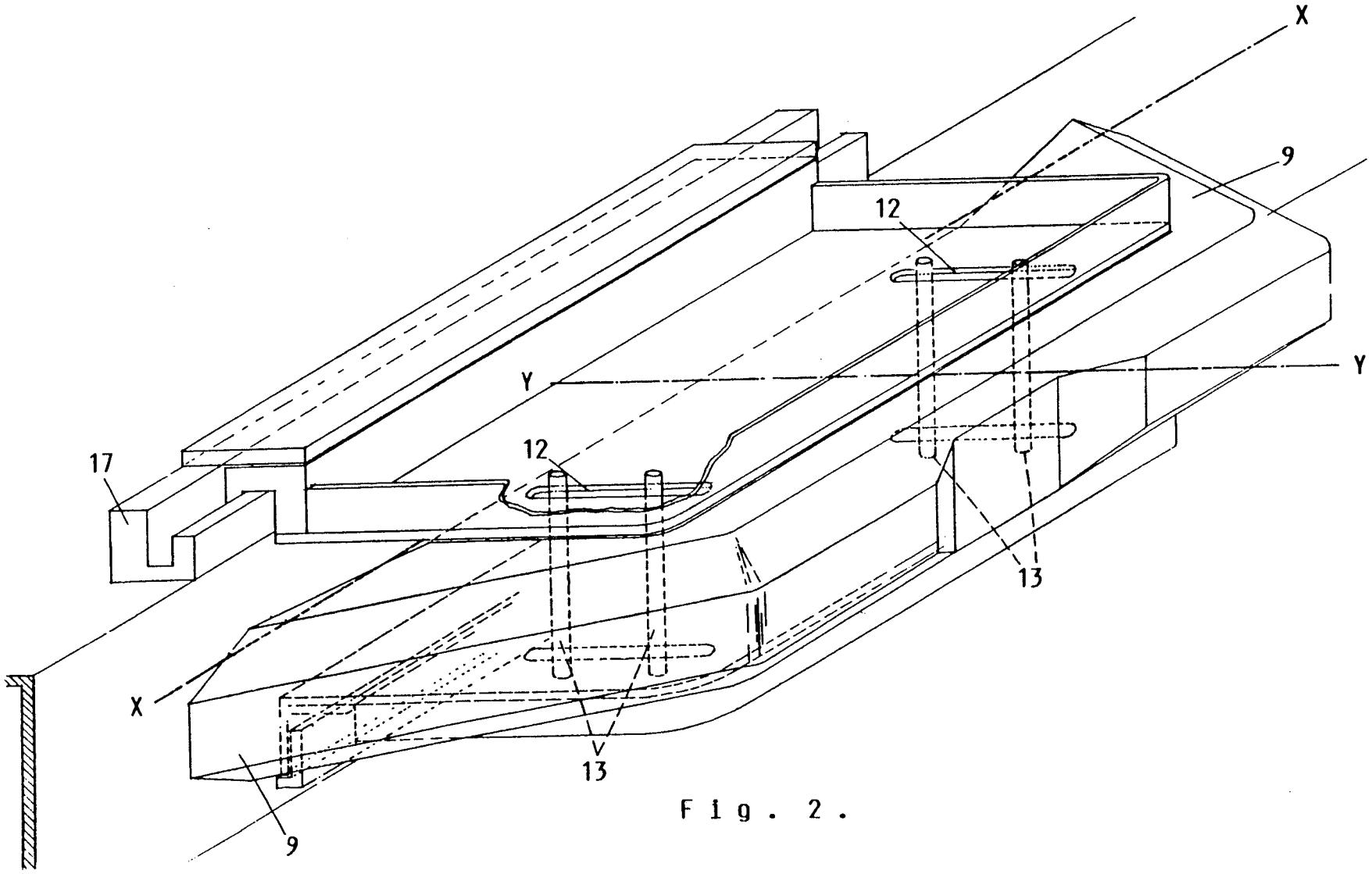
FIG. 2 shows, on a much larger scale, a perspective view of a sealing element mounted between two guiding plates.

Next to this lateral displacement according to the X-X axis (FIG. 2), they can move also in a direction perpendicular to this axis. This displacement is determined by the length of the slots 12 in the guiding plates 11. In addition to this, a certain rotational motion is also possible in the horizontal plane; i.e. parallel to the bottom of the caisson, around the interception of the X and Y axis. After having placed the caisson 1 in the right position in front of the sheet pile wall, the deformable sealing elements 9 position themselves, as already mentioned hereinabove, automatically in the grooves 6 without intervention of an operator. By inflating the inflatable air chamber 8, the desired sealing is obtained over the entire length and along the two side walls of the caisson while the pressure which is exerted onto the rigid core pushes the sealing elements 9 into their respective grooves, independent of the way wherein these grooves may be deformed.

Thanks to the flexibility of the inflatable air chamber 8, it follows in its inflated state all irregularities of the sheet piles and the profile of the sealing elements 9 pushed into the grooves 6.

FIG. 8 shows a good example of the flexibility of the device. In this figure it can be seen very clearly how the inflatable air chamber can adapt itself, only due to its elasticity, to all of the profile changes of a sheet pile wall and ensure the required watertightness of the bottom of the caisson with respect to the sheet pile wall.

The originality of the new concept with respect to sealing means for caissons as they are known from the state of the art stand now very clearly out from the just given description of the device according to the invention.

It is clear that the invention is not limited to the hereabove description given by way of example and that it could be modified in many ways without leaving the scope of the present patent application.

What is claimed is:

1. A device for sealing a caisson comprising a bottom, two upright side walls and a back wall in a watertight way against a sheet pile wall having a longitudinal profile composed of a succession of grooves and ridges, said device comprising the combination of:

a) an inflatable continuous air chamber extending along the bottom of the caisson over the total width of the caisson and along the upright side walls thereof to sealingly engage the ridges of the sheet pile wall while conforming to irregularities therein;

b) a series of deformable sealing elements disposed along the bottom of the caisson to sealingly engage the grooves of the sheet pile wall, each having a profile approaching the profile of a groove, which elements are each mounted between two horizontal guiding plates disposed one above the other in a manner such as to allow a displacement of the elements in the direction of the sheet pile wall in front of the grooves therein, while said inflatable air chamber is provided for pressing these elements against the wall to enable the deformable sealing elements to adapt to deformed and irregular grooves;

c) a core provided between each of said sealing elements and the air chamber, which core is adapted to be displaced between said guiding plates and is fixed to the adjoining sealing element; and d) means for allowing a lateral displacement of said sealing elements together with the guiding plates above and underneath these sealing elements with respect to the caisson.

2. The device as claimed in claim 1, wherein said deformable sealing elements are made of foam rubber comprising an outer layer of vulcanized rubber.

3. The device as claimed in claim 1, wherein said core is provided with at least a pair of shafts projecting through slots in said horizontal guiding plates between which said core and said air chamber are mounted.

4. The device as claimed in claim 1, wherein said sealing elements and the cores connected thereto are provided at the top and at the bottom with sliding plates.

5. The device as claimed in claim 4, wherein said sliding plates are made of a synthetic material.

6. The device as claimed in claim 1, wherein said cores do not extend laterally beyond the side edges of said guiding plates.

7. The device as claimed in claim 1, wherein said sealing elements cover a surface which is, in the absence of any pressure exerted by said core, somewhat larger than the surface measured in a groove of the sheet pile wall.

8. The device as claimed in claim 2, wherein said core is a rigid core made of a substantially undeformable material.

9. The device as claimed in claim 1, wherein said core is an inflatable core.

* * * * *